US010752984B2

(12) United States Patent
Korecki et al.

(10) Patent No.: US 10,752,984 B2
(45) Date of Patent: Aug. 25, 2020

(54) METHOD OF LOW PRESSURE CARBURIZING (LPC) OF WORKPIECES MADE OF IRON ALLOYS AND OF OTHER METALS

(71) Applicant: SECO/WARWICK S.A., Świebodzin (PL)

(72) Inventors: Maciej Korecki, Swiebodzin (PL); Agnieszka Brewka, Poznań (PL)

(73) Assignee: SECO/WARWICK S.A., Swiebodzin (PL)

( * ) Notice: Subject to any disclaimer, the term of this patent is extended or adjusted under 35 U.S.C. 154(b) by 158 days.

(21) Appl. No.: 16/106,928

(22) Filed: Aug. 21, 2018

(65) Prior Publication Data

US 2019/0055638 A1 Feb. 21, 2019

(30) Foreign Application Priority Data

Aug. 21, 2017 (PL) ..... 422596

(51) Int. Cl.
*C23C 8/22* (2006.01)

(52) U.S. Cl.
CPC ..... *C23C 8/22* (2013.01)

(58) Field of Classification Search
CPC ..... C23C 8/22; C23C 8/20
See application file for complete search history.

(56) References Cited

U.S. PATENT DOCUMENTS

| | | | | |
|---|---|---|---|---|
| 5,205,873 | A | 4/1993 | Faure et al. | |
| 5,702,540 | A | 12/1997 | Kubota | |
| 5,868,871 | A * | 2/1999 | Yokose | C21D 1/78 148/211 |
| 6,187,111 | B1 | 2/2001 | Waka et al. | |
| 9,989,311 | B2 | 6/2018 | Korecki et al. | |
| 2003/0168125 | A1 * | 9/2003 | Goldsteinas | C23C 8/22 148/235 |

FOREIGN PATENT DOCUMENTS

| | | | |
|---|---|---|---|
| EP | 0 882 811 | B1 | 7/2001 |
| EP | 1 558 781 | B1 | 10/2006 |
| PL | 202271 | B1 | 6/2009 |
| PL | 204747 | B1 | 2/2010 |
| PL | 228603 | B1 | 4/2018 |

* cited by examiner

*Primary Examiner* — Jessee R Roe
(74) *Attorney, Agent, or Firm* — Oliff PLC

(57) ABSTRACT

A method of low pressure carburizing (LPC) of elements made of iron alloys and of other metals in a device for continuous, in-line thermochemical surface treatment, with a constant time-step, with saturation at a temperature from 820° C. to 1200° C. in gaseous atmosphere, wherein into the vacuum chamber of the device a gaseous carbon carrier is introduced using impulses in a constant flow-time sequence, synchronized with the working time-step of the device.

18 Claims, No Drawings

METHOD OF LOW PRESSURE CARBURIZING (LPC) OF WORKPIECES MADE OF IRON ALLOYS AND OF OTHER METALS

The object of the invention is a method of low pressure carburizing (LPC) of workpieces made of iron alloys and of other metals in a device for continuous, in-line, thermochemical surface treatment of workpieces.

U.S. Pat. No. 5,205,873 describes a process of low pressure carburizing in a furnace chamber heated up to temperatures between 820° C. and 1100° C. The process starts in a chamber in which an initial vacuum of ca. $10^{-1}$ hPa is generated, in order to remove air. Then, once it is filled with pure nitrogen, the chamber is loaded with workpieces which are to undergo carburizing. After loading the chamber, vacuum is generated of ca. $10^{-2}$ hPa, and the charge is heated up to austenitizing temperature. Such temperature is maintained until temperature is equalized within the workpieces to be carburized, following which the chamber is filled with hydrogen up to the pressure of 500 hPa. Subsequently, ethylene, as a carrier of carbon, is introduced under the pressure from 10 to 100 hPa, and a gas mixture is generated consisting of hydrogen and ethylene, with the latter forming from 2% to ca. 60% of the volume of the mixture.

U.S. Pat. No. 6,187,111 B1 describes a method of carburizing workpieces made of steel in a furnace chamber in which vacuum from 1 to 10 hPa is generated, while the temperature in which carburizing takes place ranges from 900° C. to 1100° C. In this method the carrier of coal is gas ethylene.

U.S. Pat. No. 5,702,540 and EP 0 882 811 B1 describe the methods of vacuum carburization of workpieces made of iron alloys, carried out in vacuum furnaces at a pressure from 1 to 50 hPa, where carbon atmosphere is achieved in a hot furnace chamber from methane, propane, acetylene, or ethylene. These compounds are used individually or in mixtures. Usually, two methods are used to arrange the carbon saturation and diffusion phases in these processes. In the first one, called the impulse method, carburizing atmosphere is dosed in cycles into the vacuum furnace chamber, following which removal of reaction products takes place, until technical vacuum is obtained in the chamber, which is then maintained for several consecutive minutes. The number of impulses depends on the thickness of the generated carburized surface and ranges from a few to several dozen. The second method is an injection method, which consists in continuous dosing of carburizing atmosphere via a system of nozzles, directly onto the charge in the chamber of the vacuum furnace during the carburizing phase. During this phase, constant working pressure of the carbon-bearing atmosphere is maintained, and a diffusion phase takes place after each carburizing phase. The number of cycles in this arrangement method ranges from one to several.

Patent publication PL 202 271 B1 describes a method of carburizing steel workpieces carried out in vacuum furnaces in an oxygen-free atmosphere under reduced pressure, where the carburizing phase takes place in the atmosphere of a mixture of ethylene or propane or acetylene with hydrogen, at a volumetric ratio of 1.5 to 10, over the time of 5 to 40 minutes, with a pressure modulation from 0.1 kPa to 3 kPa, where the pressure increase time is 3 to 20 times longer than the time of reducing pressure.

Patent publication PL 204 747 B1 describes a method of carburizing steel workpieces, mainly elements of machines, vehicles, and other mechanical devices, in vacuum furnaces under reduced pressure at an increased temperature. The method of carburizing steel elements in reduced pressure consists in the introduction of the carrier of active nitrogen during the time of heating up the charge. The process of introducing the carrier of active nitrogen stops when the charge reaches the temperature required for the carburizing process to start, and then the carrier of carbon is fed in. Over the time of introducing the active nitrogen carrier, the pressure in the furnace chamber should be maintained between 0.1 and 50 kPa.

Additionally, a Polish patent application no. P.411158, describes a multi-chamber furnace for vacuum carburizing and quenching with an in-line flow of processed workpieces through connected process chambers.

According to the invention, the essence of this low pressure carburizing (LPC) method is the introduction of a gaseous carbon carrier into a device for continuous, in-line thermochemical surface treatment of workpieces at a carburizing temperature from 820° C. to 1200° C., which introduction is performed in impulses at a constant flow-and-time sequence synchronized with the working time-step of the device.

It is preferable for the gaseous carbon carrier to be introduced during every work time-step of the device or to skip from 1 to 5 time-steps.

It is also preferable for the gaseous carbon carrier to be introduced in a sequence consisting from 1 to 5 impulses per time-step.

It is also preferable to introduce the gaseous carbon carrier in impulses with a flow of 0.1 to 100 $dm^3$ per minute, with the duration of impulses lasting from 1 to 300 seconds.

Further, it is preferable for the gaseous carbon carrier to be introduced under constant absolute pressure between 0.2 and 10 hPa.

Additionally, it is also preferable for the gaseous carbon carrier to be a hydrocarbon, for example acetylene or a mixture of hydrocarbons.

According to the invention, this way of carburizing allows the formation of carburized layers with an unlimited distribution of the carbon concentration gradient resulting from an adjustment of the following process parameters: temperature, pressure, duration of time-step and impulse, as well as the flow of the gaseous carbon carrier. This is in particular important when higher temperatures are used, which shortens the time of the process and reduces costs.

Skipping time-steps during impulsing: if no time-steps are skipped the gas impulse is the same during each time-step; if one time-step is skipped—then the impulse is in every second time-step; if two time-steps are skipped—then the impulse is in every third time-step, etc.

EXAMPLE 1

A batch of identical toothed gears made of 16MnCr5 steel, weighing 2.49 kg, of a surface of 0.054 $m^2$, at a 180 second time-step, was placed in a vacuum furnace with in-line workpiece flow, consisting of 3 process chambers for, respectively, heating, carburizing, and diffusion, each consisting of 15 positions. In sequence, the wheels moved through all the 15 positions in 3 chambers, starting from the heating one, and followed by the carburizing, and the diffusion one. In the heating chamber they were heated up to the temperature of 950° C. Then, in the carburizing chamber, which had been heated up to the temperature of 950° C., the wheels underwent low pressure carburizing by the introduction of acetylene for 8 seconds at a flow of 16 $dm^3$ per minute in each of the 180 second time-steps, for each of the 15 positions. Following that, the wheels moved to the diffusion chamber, where they remained in 10 positions at the temperature of 950° C., while at the remaining 5 positions the temperature was reduced to 860° C. Then, the wheels were individually quenched in nitrogen under the pressure of 0.3 MPa, and tempered at 180° C. in an accompanying device.

On all wheels a uniform carburized surface was achieved of a conventional thickness of 0.60±0.02 mm measured on the side surface of the tooth, with proper martensitic microstructure, without any carbide precipitation in the subsurface area.

The surface of carburized elements showed a metallic shine, and there was no carbon-related contamination in the furnace installation.

EXAMPLE 2

A batch of identical toothed gears made of 16MnCr5 steel, weighing 1.66 kg, of a surface of 0.07 $m^2$, at a 90 second time-step, was placed in a vacuum furnace with in-line workpiece flow, consisting of 3 process chambers for, respectively, heating, carburizing, and diffusion, each consisting of 15 positions. In sequence, the wheels moved through all the 15 positions in 3 chambers, starting from the heating one, and followed by the carburizing, and the diffusion one. In the heating chamber they were heated up to the temperature of 1040° C. Then, in the carburizing chamber, which had been heated up to the temperature of 1040° C., the wheels underwent low pressure carburizing by the introduction of acetylene for 10 seconds at a flow of 22 $dm^3$ per minute in each 90 second time-step, for each of the 15 positions. Following that, the wheels moved to the diffusion chamber, where they remained in 10 positions at the temperature of 1040° C., while at the remaining 5 positions the temperature was reduced to 860° C. Then, the wheels were individually quenched in nitrogen under the pressure of 0.3 MPa, and tempered at 180° C. in an accompanying device.

On all wheels a uniform carburized surface was achieved of a conventional thickness of 0.65±0.02 mm measured on the side surface of the tooth, with proper martensitic microstructure, without any carbide precipitation in the subsurface area.

The surface of carburized elements showed a metallic shine, and there was no carbon-related contamination in the furnace installation.

The invention claimed is:

1. A method of low pressure carburizing (LPC), intended for use in a device for continuous thermochemical surface layer treatment, working in a step-by-step mode with a constant time-interval and with saturation at a temperature from 820° C. to 1200° C. in gaseous atmosphere, wherein a gaseous carbon carrier is introduced by pulses into a pass-through vacuum process chamber of the device and wherein a gaseous carbon carrier, used in this carburizing process, is a hydrocarbon, wherein the gaseous carbon carrier is introduced into the process chamber in a constant flow-time sequence synchronized with every change of the workpieces' positions, wherein the workpieces are transferred along the process chamber, in which "n" machining-positions are provided, in the following mode: in each time-step, every workpiece passes one machining-position forward, in the direction from input to output of the said chamber.

2. A method according to claim 1, wherein the gaseous carbon carrier is introduced during every work time-step of the device or skipping from 1 to 5 time-steps.

3. A method according to claim 2, wherein the hydrocarbon is acetylene or a mixture of hydrocarbons.

4. A method according to claim 2, wherein the gaseous carbon carrier is introduced in impulses with a flow of 0.1 to 100 $dm^3$ per minute, with the duration of impulses lasting from 1 to 300 seconds.

5. A method according to claim 2, wherein the gaseous carbon carrier is introduced under absolute pressure between 0.2 and 10 hPa.

6. A method according to claim 5, wherein the hydrocarbon is acetylene or a mixture of hydrocarbons.

7. A method according to claim 1, wherein the gaseous carbon carrier is introduced in a sequence consisting from 1 to 5 impulses per time-step.

8. A method according to claim 7, wherein the hydrocarbon is acetylene or a mixture of hydrocarbons.

9. A method according to claim 7, wherein the gaseous carbon carrier is introduced in impulses with a flow of 0.1 to 100 $dm^3$ per minute, with the duration of impulses lasting from 1 to 300 seconds.

10. A method according to claim 7, wherein the gaseous carbon carrier is introduced under absolute pressure between 0.2 and 10 hPa.

11. A method according to claim 10, wherein the hydrocarbon is acetylene or a mixture of hydrocarbons.

12. A method according to claim 1, wherein the hydrocarbon is acetylene or a mixture of hydrocarbons.

13. A method of carburizing iron alloys and other metals in a device for continuous, in-line thermochemical surface treatment, with a constant time-step, with saturation at a temperature from 820° C. to 1200° C. in gaseous atmosphere, wherein into a vacuum chamber of the device a gaseous carbon carrier is introduced using impulses in a constant flow-time sequence, synchronized with the working time-step of the device; wherein the gaseous carbon carrier is introduced during every work time-step of the device or skipping from 1 to 5 time-steps, and the gaseous carbon carrier is introduced in impulses with a flow of 0.1 to 100 $dm^3$ per minute, with the duration of impulses lasting from 1 to 300 seconds.

14. A method according to claim 13, wherein the gaseous carbon carrier is a hydrocarbon.

15. A method according to claim 14, wherein the hydrocarbon is acetylene or a mixture of hydrocarbons.

16. A method of carburizing iron alloys and other metals in a device for continuous, in-line thermochemical surface treatment, with a constant time-step, with saturation at a temperature from 820° C. to 1200° C. in gaseous atmosphere, wherein into a vacuum chamber of the device a gaseous carbon carrier is introduced using impulses in a constant flow-time sequence, synchronized with the working time-step of the device; wherein the gaseous carbon carrier is introduced in a sequence consisting from 1 to 5 impulses per time-step, and the gaseous carbon carrier is introduced in impulses with a flow of 0.1 to 100 $dm^3$ per minute, with the duration of impulses lasting from 1 to 300 seconds.

17. A method according to claim 16, wherein the gaseous carbon carrier is a hydrocarbon.

18. A method according to claim 17, wherein the hydrocarbon is acetylene or a mixture of hydrocarbons.

* * * * *